United States Patent [19]

Wirth

[11] 4,167,146

[45] Sep. 11, 1979

[54] TRASH INCINERATING OVEN

[75] Inventor: Ernst Wirth, Zürich, Switzerland

[73] Assignee: Swissmechanic, Sektion Schwyz, Schwyz, Switzerland

[21] Appl. No.: 853,533

[22] Filed: Nov. 21, 1977

[30] Foreign Application Priority Data

Nov. 30, 1976 [CH] Switzerland ..... 15080/76

[51] Int. Cl.[2] ..... F23G 5/00; F23J 1/00

[52] U.S. Cl. ..... 110/251; 110/254; 110/259; 110/346

[58] Field of Search ..... 110/251, 256, 252, 254, 110/259, 346

[56] References Cited

U.S. PATENT DOCUMENTS

| | | | |
|---|---|---|---|
| 1,544,323 | 6/1925 | Kener, Jr. | 110/259 |
| 1,545,497 | 7/1925 | Kener, Jr. | 110/252 |
| 2,715,881 | 8/1955 | O'Neil | 110/251 |
| 2,754,779 | 7/1956 | Toepel | 110/251 |
| 3,961,587 | 6/1976 | Ozawa | 110/251 |

*Primary Examiner*—Kenneth W. Sprague

*Attorney, Agent, or Firm*—Frishauf, Holtz, Goodman, Woodward

[57] ABSTRACT

The combustion chamber of the oven is bounded at the top by a lid which can be swung open and at the bottom by a grating. The grating has one or more sections which pivot about an axis to dump slag. A hollow interior of the grating forms a section of the exhaust gas system. The lid includes a channel for air supply, the air passing through a perforated plate in the bottom of the lid into the combustion chamber. A perforated tube extending vertically along the axis of the combustion chamber opens into the channel in the lid and supplies air down into combustible materials filled into the combustion chamber. The depth to which the air is supplied can be regulated by a piston which can be adjusted vertically within the tube to extend the air flow to the depth desired. The incinerator is filled from above in layers. Mixed with the trash filled into the incinerator are certain amounts of fluid supplements which may or may not be themselves combustible, with the type and quantity of such supplements being determined by the heat content and the combustion temperature of the trash.

6 Claims, 1 Drawing Figure

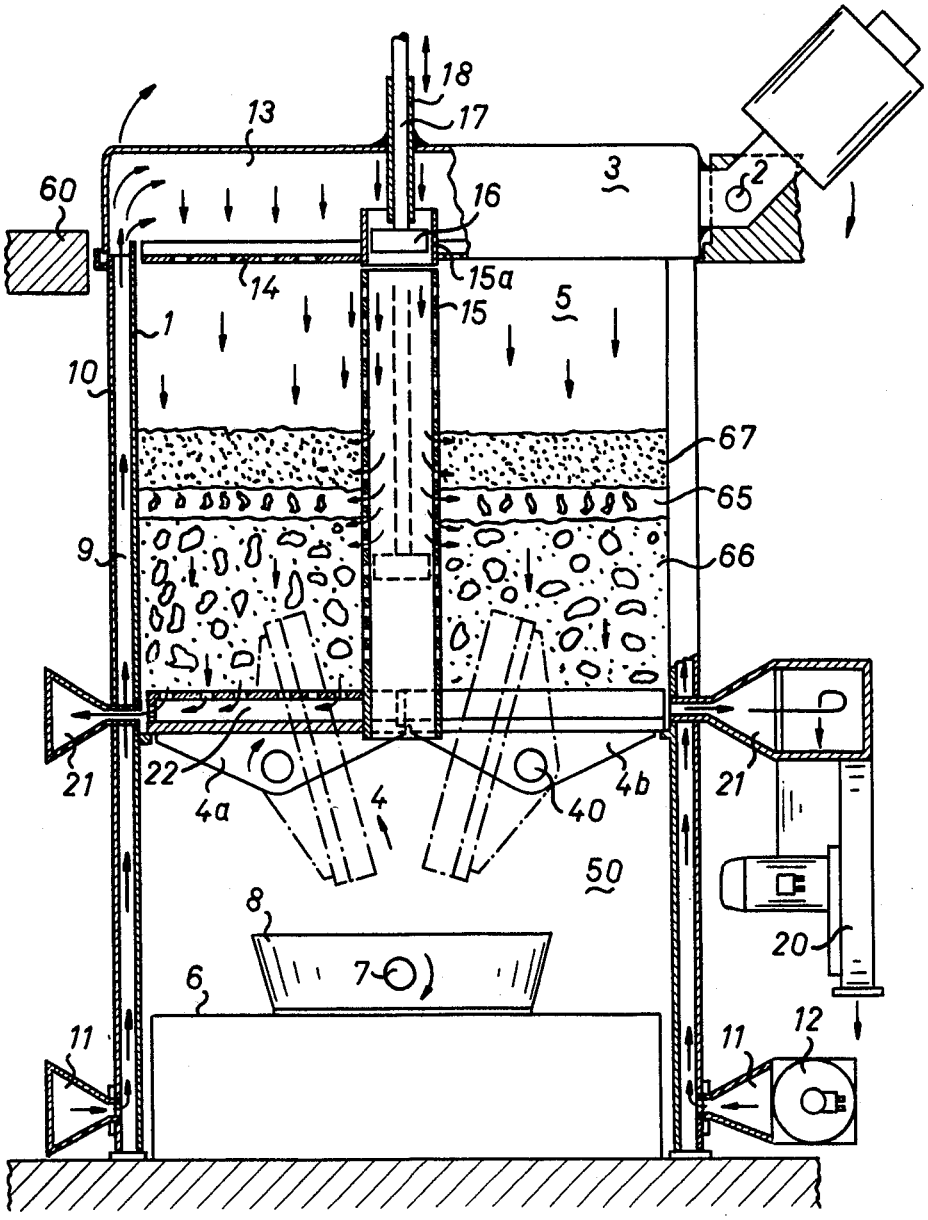
18
17
13
3
2
60
16
14
15a
15
5
1
10
67
65
9
66
21
22
4a
4
40
4b
21
50
8
20
6
7
11
12
11

TRASH INCINERATING OVEN

BACKGROUND OF THE INVENTION

The present invention relates to a trash incinerating over which has a combustion chamber within a mantle, the chamber being bordered at the bottom by a grating and at the top by a lid which may be swung open, whereby the combustion chamber has a flow connection with an air delivery system as well as with an exhaust gas system.

The disposal of trash in smaller industrial firms, in small communities, on individual frame, mountain hotels, and the like poses special problems, since an expensive trash incineration installation such as is provided in large municipal regions is naturally out of the question there.

Appropriate attempts to downscale such known large installations to the required small conditions necessary failed, since the principle of combustion used therein was no longer effective for the smaller trash quantity. Also, for such down-scaled installations the operating costs per metric ton or per resident per year were significantly greater than for large installations.

While the known large installations as well as the down-scaled reproductions rely essentially on the principle of continuous trash supply into the oven onto a combustion grating, by which the combustion always proceeds from the bottom to the top in a so-called bottom combustion, it has already been suggested that for small installations there be used boiler-shaped ovens which are intermittently supplied from above, then closed for a combustion cycle, and in which the combustion likewise proceeds by a bottom combustion.

Aside from their high construction costs and operating costs, such small trash incinerating ovens also do not satisfy the present environmental protection requirements.

THE INVENTION

It is an object to create a trash incinerating oven of the above-described type which satisfies environmental protection demands to the greatest extent, and which from its conception, especially with regard to servicing costs, operating costs, installation and use is acceptable to, and within reach of, the private person.

Briefly, the air supply system comprises a channel section bounded by the lid and which is separated from the combustion chamber and connecting with the mentioned channel section, the vertical travel of the piston being adjustable by means of a piston rod extending through the lid, the cylinder also acting in the vicinity of the grating as a flow connection between the combustion chamber and the exhaust gas system.

In a preferred embodiment, such a trash incinerator can be so designed that the air supply system comprises a ring-shaped channel about the chamber mantle, through which the air flows from below upwards to the lid and thereby surrounds the chamber mantle.

It is further advantageous for the grating to consist of one or a plurality of individually pivotable grating segments.

An advantageous embodiment for this purpose is for the grating to form a channel section of the exhaust gas system and to be connected on one side with the flow of the combustion chamber and on the other side with an exhaust unit.

These means permit such a trash incinerating oven to be operated in such a way as to result in a charge-wise supplying from the top and the maintaining of a continuous, stable, combustion which can be regulated and which always remains in the upper-most region of the combustion zone through control of the air supply to the exhaust gas removal, or rather by regulate means of doses of fluid supplements to the trash as appropriate for the combustion rate and the reaction temperature.

BRIEF DESCRIPTION OF THE DRAWING

The drawing shows a vertical sectional schematic view through a trash incinerator in accordance with the invention.

DESCRIPTION OF THE PREFERRED EMBODIMENT

The illustrated trash incinerating oven has a steel sheet mantle 1, which is preferably cylindrical, but may also have any desired possible cross section. It is, of course, also possible to construct such a chamber out of fire brick or the like. This mantle features at the top a supply opening which can be hermetically sealed by a removable lid 3, which is preferably pivotable about the axis 2.

Approximately in the middle of the chamber 1 is a grating system 4, which divides the chamber 1 into an upper combustion chamber 5 and a lower slag removal chamber 50.

In the removal chamber there can be provided, for example, a bridge 6 with underpass, on which is disposed a slag container 8 which may be rotated about the pivot axis 7. This is only by way of example, however, since there exist a large number of other possibilities for carrying off the combustion residues from the trash incinerator.

The illustrated trash incinerating oven further comprises an air supply system, as well as an exhaust gas system, which will be separately described below.

The air supply system comprises first of all a ring-shaped channel 9 about the chamber mantle 1 and bounded toward the outside by an outer mantle 10. This annular channel 9 leads the supplied combustion air from below to above, in accordance with the arrows drawn in. The entrance of the air through a ring-shaped channel 11 is forced by a blower unit 12. The upper end of the ring-shaped channel 9 opens into a channel portion 13, which is formed within the lid 3. As can be recognized from the arrows drawn in, this channel section 13 has its flow connected with the combustion chamber 5 through a perforated plate 14. This perforated plate 14 also closes off the top of the combustion chamber 5.

The air supply system here further comprises a piston-cylinder arrangement 15,16,17,18. Here, this arrangement extends coaxially with the chamber axis, which is of course not essential. In particular, it is quite conceivable to provide a plurality of such arrangements, which can then extend through the chamber 5 evenly distributed about the chamber axis. The cylinder 15 of this arrangement is formed by a perforated tube which at the top extends with a separate segment **15*a* through the perforated plate 14 and thereby has its flow connected with the lid-channel section 13. At the bottom, the open tube 15 extends through the grating arrangement 4 and opens freely into the removal chamber 50. The tube 15** may be supported from the side of the chamber mantle or form the bottom in any desired manner (not shown).

The piston 16 can be pushed along within the tube 15 by its piston rod 17, for which purpose the piston rod 17 extends through the lid 3 to the exterior through a guide 18. In the illustration, the piston 16 is in its extreme upper position within the tube section 15*a*, which is rigidly fastened to the lid 3. In this position, the lid 3 may then be swung open. For operation of the piston rod 17, there may be fastened to it a rod or the like (not shown).

As the illustration shows by the piston drawn in broken lines, the piston 16 may be moved downwards during the operation of the trash incinerating oven, through which an ever greater section of the tube 15 is connected in flow communication with the channel section 13, as can be seen from the illustrated flow arrows and as will be described in more detail below.

The exhaust gas system of the shown trash incinerator comprises first of all an exhaust unit 20, which has its flow connected with the interior of the chamber by an annular channel 21. Channel sections 22 between the combustion chamber 5 and the annular channel 21 are formed by hollow chambers in the grating 4, the grating 4 consisting of the grating segments 4*a* and 4*b*. These grating segments 4*a* and 4*b* may be pivoted about the axis 40 from the shown postion to the position shown in broken lines, in order for them to empty into the slag container 8 and drop the slag material accumulated on them. Naturally, in this connection there are also other alternative solutions. For example, the gas may exit not only through the grating, but may pass immediately over it. The grating, or rather its individual segments or individual elements, may furthermore be shaken mechanically; or, the grating may be a pull-grating.

An oven of the type described above may have, for example, a diameter of 1.90 m, a height of 3.00 m, a combustion chamber height of 1.50 m and a combustion chamber volume of 4.5 $m^3$. The air flow to the combustion air may be to 0.3 $m^3$/sec which can be supplied by a unit with a motor of about 5 Hp. The pressure of this combustion air should be about 100–150 mm Hg.

A trash incinerating oven so dimensioned has taken about 20 to 30 minutes buring time, with the gases given off in the smoke fluctuating within the limits authorized for pollutants without afterburing, namely; for $CO_2$ about 7 volume %; for $O_2$ about 11.5 volume %; and, for $N_2$ about 81.5 volume %, with a supplemental mix to the trash of 25% water.

The following should describe the operation of a trash incinerating oven as described above.

To begin with, the trash incinerating oven is filled with organic waste from above, possibly from a ramp 60. This filling material may be sweepings from households, industrial wastes, packaging material, oil-soaked earth, synthetic wastes, waste wood such as bark, poorly burned slag and other materials. To this trash there may be added used oil or other readily combustible materials when the trash has too low a heat content. Furthemore, prior to the filling there may be mixed in as is suitable water or water solutions or water sediment; or oil sediment, emulsions, and so on. The mixing in of such fluids is in accordance with the heat value of the solid wastes, and is determined alone by the temperature specified for the combustion zone. For wastes with a very high heat value, the fluid supplement content may be as much as 50% by volume.

The entering of the loading into the combustion chamber occurs in a suitably layered manner, in which then there is provided a final layer of readily combustible materials directly under the perforated plate 14 of the lid 3. This initial combustible material is then ignited in a suitable manner, which need not be described here in more detail, upon which there begins the combustion from the top toward the bottom. Hereby, the hot gases of the initial combustible material layer vaporize water out of the next layer, by which the gases are cooled. An equilibrium is established between the developed heat of combustion and the heat of vaporization, by which the following layer is not only dried, but also ignited, whereby the combustion residues 67 of the combusted layers remain lying over the burning layer 65 of the loading 66. The presentation shows that it is possible by means of the piston-cylinder system to precisely control the combustion, layer by layer, by a radial air influx which has a height that may be limited to the layer in question; this permits a very high combustion rate as a result of a large oxygen enrichment. Precisely this, however, is the condition for a mixture high in fluids. A mixture high in fluids, on the other hand, is again a measure for the quality of the exhaust gases.

In this manner there is produced a trash incinerating oven which satisfies completely all the conditions specified in the introduction.

The present trash incinerating oven has also the inherent advantage of any desired practical dimension. There further readily exists the possibility of building a fully automatic installation with bunker, homogenizer, supplier, moisturizer, slag remover, exhaust gas utilizer and other equipment.

I claim:

1. An incinerating oven to incinerate a fill such as trash, refuse, waste material and the like having a mantle (10) defining a combustion chamber therein;

a grating (4) delimiting the chamber at the bottom;

a movable lid closing the chamber at the top;

an air supply system (9–16) and an exhaust gas system (20, 21, 22) communicating with the chamber, wherein, in accordance with the invention, the air supply system comprises a channel section (13) located in the lid (3);

means (11, 12) supplying combustion air to said channel section;

perforate means (14) separating the channel section from the combustion chamber (5) to permit escape of combustion air from the channel section in the lid towards the top of the combustion chamber;

at least one piston-cylinder arrangement, the cylinder or cylinders (15) of which extend vertically through the combustion chamber and being formed by perforate tubes (15) in flow communication with the channel section (13) in the lid, and adapted to be surrounded by the fill within the combustion chamber;

a vertically adjustable piston (16) movable in the cylinder and having positioning means (17) extending through the lid to adjust the position of the piston within the cylinder and thereby control the flow of air from the channel section (13) in the lid through the perforate tube and through the perforations thereof and hence the level at which combustion air is being supplied to the fill within the chamber and permit supply of air at various levels thereto as the fill burns from the top down;

and the exhaust gas system comprises a flow connection between the combustion chamber (5) and the exhaust gas system (20, 21, 22) located in the vicinity of the grating.

2. Oven according to claim 1, wherein the air supply system includes a ring-shaped channel (9) surrounding the mantle (1) defining the combustion chamber;

and the combustion air supply means (11, 12) direct air through the channel and surrounding said mantle (1) from below upwards towards the lid (3).

3. Oven according to claim 1, wherein the grating (4) comprises one or more individually pivotable grating sections (4*a*, 4*b*).

4. Oven according to claim 1, wherein the grating (4) is hollow and forms a duct section (22), said duct section being part of the exhaust gas system (20, 21, 22) and being in flow communication on one side with the combustion chamber (5) to receive combustion gases from the chamber;

and an exhaust unit (20) in flow communication with said duct section.

5. Oven according to claim 2, wherein the grating (4) is hollow and forms a duct section (22), said duct section being part of the exhaust gas system (20, 21, 22) and being in flow communication on one side with the combustion chamber (5) to receive combustion gases from the chamber;

and an exhaust unit (20) in flow communication with said duct section.

6. Method of incinerating trash, refuse, waste material and the like forming a fill for an incinerating oven having a mantle (10) defining a combustion chamber therein;

a grating (4) delimiting the chamber towards the bottom;

a movable lid (3) closing the chamber at the top;

and an air supply system (9–16) and an exhaust gas system (20, 21, 22) communicating with the chamber;

wherein the air supply system comprises a channel section (13) located in the lid;

means (11, 12) supplying combustion air to said channel section;

perforate means separating the channel section from the combustion chamber;

at least one piston-cylinder arrangement, the cylinder or cylinders (15) of which extend vertically through the combustion chamber and being formed by a perforate tube in flow communication with said channel section and adapted to be surrounded by the fill within the combustion chamber;

a vertically adjustable piston (16) movable in the cylinder and having positioning means (17) extending through the lid to adjust the position of the piston within the cylinder;

and wherein the exhaust gas system comprises a flow connection between the combustion chamber (5) and the exhaust gas system (20, 21, 22) situated in the vicinity of the grating, said method comprising the steps of moving the lid from closing position with respect to the chamber at least partially filling said chamber with said fill and reclosing the lid;

igniting the uppermost layer of said chamber;

and controlling air flow to the layers below the ignited layer by vertically adjusting the level of said piston (16) within the cylinder (15) formed by said perforate tube to be below the ignited layer and supply combustion air to the fill below said ignited layer.

* * * * *